US006595279B2

(12) United States Patent
Collie

(10) Patent No.: US 6,595,279 B2
(45) Date of Patent: Jul. 22, 2003

(54) DATA LINE DEPLOYMENT IN HYDROCARBON WELLS

(75) Inventor: Graeme John Collie, Dunfermline (GB)

(73) Assignee: FMC Technologies, Inc., Chicago, IL (US)

( * ) Notice: Subject to any disclaimer, the term of this patent is extended or adjusted under 35 U.S.C. 154(b) by 0 days.

(21) Appl. No.: 09/802,530

(22) Filed: Mar. 7, 2001

(65) Prior Publication Data

US 2001/0035287 A1 Nov. 1, 2001

(30) Foreign Application Priority Data

Mar. 9, 2000 (GB) ..... 0005710

(51) Int. Cl.[7] ..... E21B 33/047; E21B 34/02
(52) U.S. Cl. ..... 166/88.4; 166/86.3; 166/97.5
(58) Field of Search ..... 166/373, 385, 166/54.5, 88.4, 97.5, 86.3, 368

(56) References Cited

U.S. PATENT DOCUMENTS 4,109,712 A * 8/1978 Regan ..... 166/332.5
4,215,749 A * 8/1980 Dare et al. ..... 137/68.13
4,230,299 A * 10/1980 Pierce, Jr. ..... 137/315.28
4,572,298 A * 2/1986 Weston ..... 166/316
4,612,983 A 9/1986 Karr, Jr.
4,660,635 A * 4/1987 Wittrisch ..... 166/156
4,911,410 A 3/1990 Baker
5,501,424 A 3/1996 Williams et al.
5,667,008 A * 9/1997 Moore ..... 166/65.1
5,803,431 A * 9/1998 Hoang et al. ..... 251/326
5,941,574 A 8/1999 Hamilton et al.
5,992,527 A * 11/1999 Garnham et al. ..... 166/379
6,357,529 B1 * 3/2002 Kent et al. ..... 166/344
2001/0042618 A1 * 11/2001 Cunningham et al. ..... 166/86.3
2001/0054507 A1 * 12/2001 Bartlett et al. ..... 166/368

FOREIGN PATENT DOCUMENTS

EP 0845577 A1 * 3/1998 ..... E21B/33/035

* cited by examiner

*Primary Examiner*—David Bagnell
*Assistant Examiner*—Jennifer H Gay
(74) *Attorney, Agent, or Firm*—Henry C. Query, Jr.

(57) ABSTRACT

A preferably fiber optic line passes into a well interior through a pressure barrier such as a tree or wellhead housing, via a modified horizontal penetrator assembly. The penetrator assembly comprises double poppet valve assemblies arranged to open upon engagement of the penetrator with an interior well component such as a tubing hanger. Retraction of the penetrator closes the poppet valves, sealing the pressure barrier, severing the line and allowing the tubing hanger to be pulled. A replacement line is readily installed through the open poppet valve assemblies.

10 Claims, 4 Drawing Sheets

DATA LINE DEPLOYMENT IN HYDROCARBON WELLS

BACKGROUND OF THE INVENTION

The present invention relates to a penetrator assembly for establishing communication between a tubing hanger and a surrounding christmas tree or wellhead housing. More particularly, the invention relates to such a penetrator which comprises at least one retractable member and a valve member which, upon retraction of the retractable member, will sever a data line extending from the tree or wellhead housing, through the penetrator assembly, and into the tubing hanger.

Monitoring of downhole conditions has traditionally been accomplished with electronic transducers. These are sited at regular intervals along the length of the tubing and also at reservoir level, and are used to monitor parameters such as temperature, pressure and stress levels. The disadvantage of this system is the difficulty in maintaining electrical contact in the environment which is being monitored. This can lead to erroneous information on the downhole situation, and therefore lost time.

More recently, the advent of fiber optic diagnostic systems has substantially reduced this disadvantage. A fiber optic loop is fed downhole, and a signal sent and received at opposing ends. The generated and received signals are compared using a decoder, and the downhole conditions are interpreted, providing a faster, more reliable monitoring method.

The monitoring line must pass downhole from outside the well, usually through the christmas tree to inside the tubing hanger, such that pressure integrity is not compromised. Any such access into the well requires a gas tight pressure seal to be set up around the line. During operations such as workovers, the fiber optic line presents a further problem. The line is usually routed through the completion in a way that will cause it to be broken if the tubing hanger and attached tubing string is pulled. The time involved in retrieving the line prior to pulling the tubing hanger renders the option of line retrieval impractical. Retrieval also presents another problem in that the line feed path must be sealed afterwards.

SUMMARY OF THE INVENTION

In accordance with the present invention there is provided a pressure barrier for retaining well fluid separate from a surrounding environment, characterized in that the barrier comprises a valve through which a data line extends between the environment and the well interior, the valve being sealably closable to sever the line. The line itself is relatively inexpensive to replace, and any pieces of sheared line remaining downhole can be flushed out before installation of a replacement line. When closed, the valve will maintain the pressure integrity of the barrier. This system has the benefit of minimizing costs, since it is much faster and easier to shear the line and seal its path into the well simply by closing the valve, than it is to retrieve the line and then plug its vacated path into the well. Although the invention is beneficial for use with fiber optic lines, it may also be employed in conjunction with any relatively small diameter line (electrical, optical or other) capable of being severed by a valve and which is relatively inexpensive to replace.

The valve may comprise a valve housing having a valve closure member movably received therein, the line passing through aligned apertures in the housing and closure member, movement of the closure member to close the valve causing the apertures to move out of alignment and sever the line.

Preferably the pressure barrier comprises a penetrator incorporating the valve and movable between a position in which the penetrator engages an interior well component and a position in which the penetrator is disengaged from the component, allowing the component to be pulled from or installed in the well. The component may include a further valve through which the line passes. Preferably the or each valve is closeable upon disengagement of the penetrator from the component. For example, the valve or valves may comprise poppet valves having sufficient closure bias to sever the line. The valves may be arranged to be opened by engagement of the penetrator with the component.

The invention and its preferred features and advantages are described below with reference to an illustrative embodiment shown in the drawings.

DETAILED DESCRIPTION OF THE PREFERRED EMBODIMENTS

Figure 1:
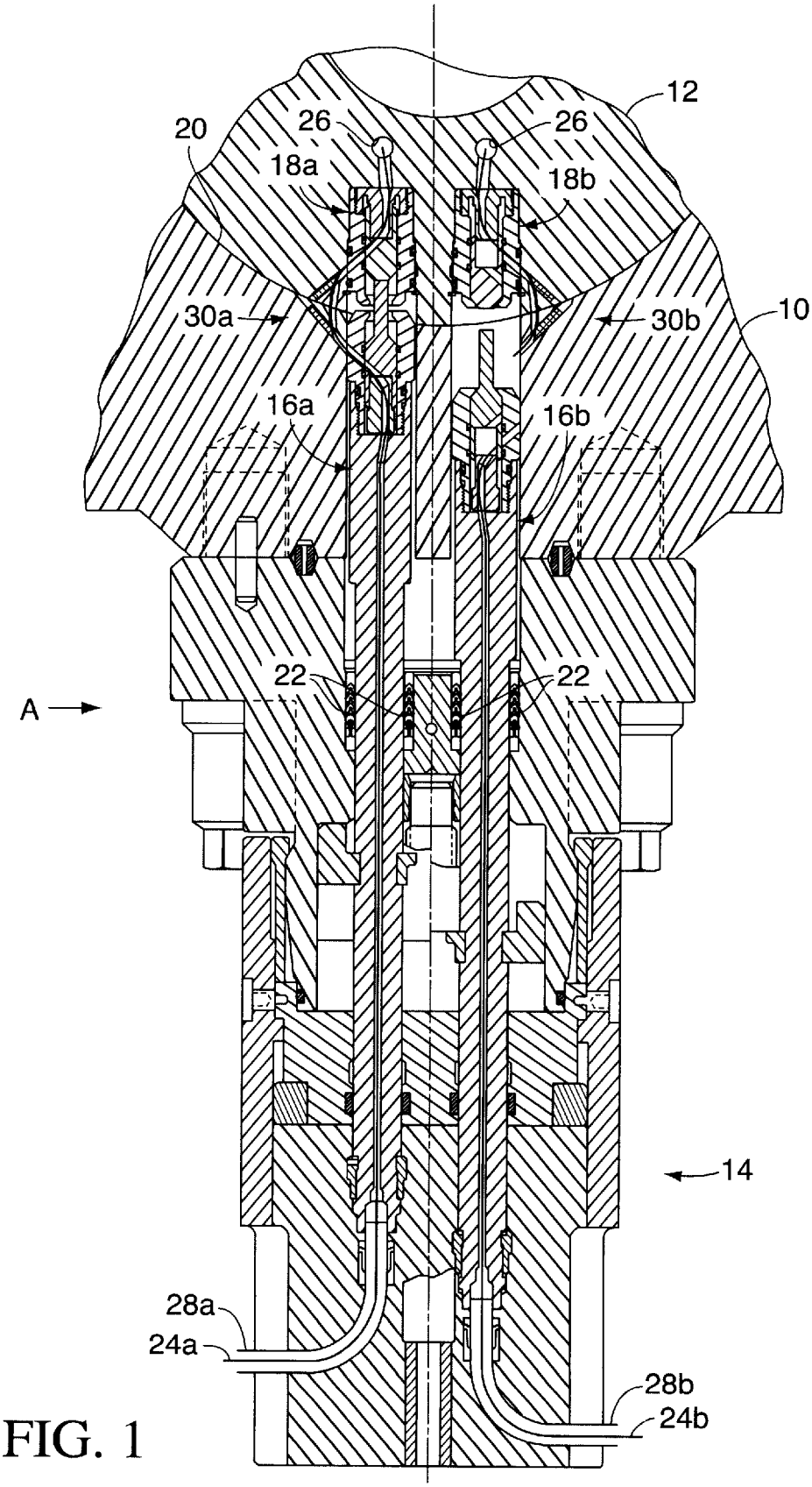
FIG. 1 is a horizontal sectional view of parts of a christmas tree or wellhead, a tubing hanger and a multiple penetrator assembly embodying the invention.

Referring to FIG. 1, there is shown a christmas tree or wellhead 10 (hereinafter "tree") surrounding a tubing hanger 12. A multiple horizontal penetrator assembly 14 modified to incorporate poppet valves in accordance with a preferred embodiment of the invention has male parts 16*a*, 16*b* mounted to the tree for co-operation with corresponding female parts 18*a*, 18*b* in the tubing hanger. Penetrator assemblies as such are well known and are normally used to provide electrical or hydraulic connections between a tubing hanger and a surrounding wellhead or tree. See, for example, U.S. Pat. No. 5,941,574. The general construction and operating principles of such penetrators, as distinct from the various modifications discussed below, do not form part of the present invention and will not be further described in detail.

The male parts 16*a*, 16*b* are axially movable in known manner to engage with or disengage from the female parts 18*a*, 18*b*. Part 16*a* is shown engaged with part 18*a* and parts 16*b* and 18*b* are shown disengaged. When disengaged, the male and female parts 16*a*, 16*b* and 18*a*, 18*b* respectively, lie on opposite sides of the generally cylindrical boundary surface 20 between the tubing hanger 12 and tree 10, allowing the tubing hanger to be run into or retrieved from the tree without interference. The male parts 16*a*, 16*b* extend through suitable sliding seals or packings 22, so as to maintain the pressure integrity of the tree 10.

Lengths of fiber optic line 24*a*, 24*b* extend through the hollow interiors of the male parts 16*a*, 16*b*, through the female parts 18*a*, 18*b*, as described in more detail below, and downhole through vertical bores 26 in the tubing hanger 12.

The lengths 16*a*, 16*b* may comprise opposite ends of a single loop extending down through one of the parts 16*a*, 16*b* and up through the other. The loop may be installed by attaching to the end of the line a small ball or "bullet" having a larger diameter than the line. The bullet is of a suitable size and shape to pass freely along a circulation path extending downhole through one of the penetrator parts 16*a* or 16*b* and then back out of the well through the other. The bullet and attached line are pumped through the ports and passageways forming the circulation path, with fluid drag on the line and bullet pulling them along. The additional drag on the larger diameter bullet maintains sufficient tension on the line leading end to prevent kinking. The ends of the line are housed in metal conduits 28*a*, 28*b* connected by pressure tight joints to the male parts 16*a*, 16*b*. The line ends 24*a*, 24*b* exit the conduits 28*a*, 28*b* through suitable pressure tight glands (not shown), thereby maintaining the pressure integrity of the well.

Figure 2:
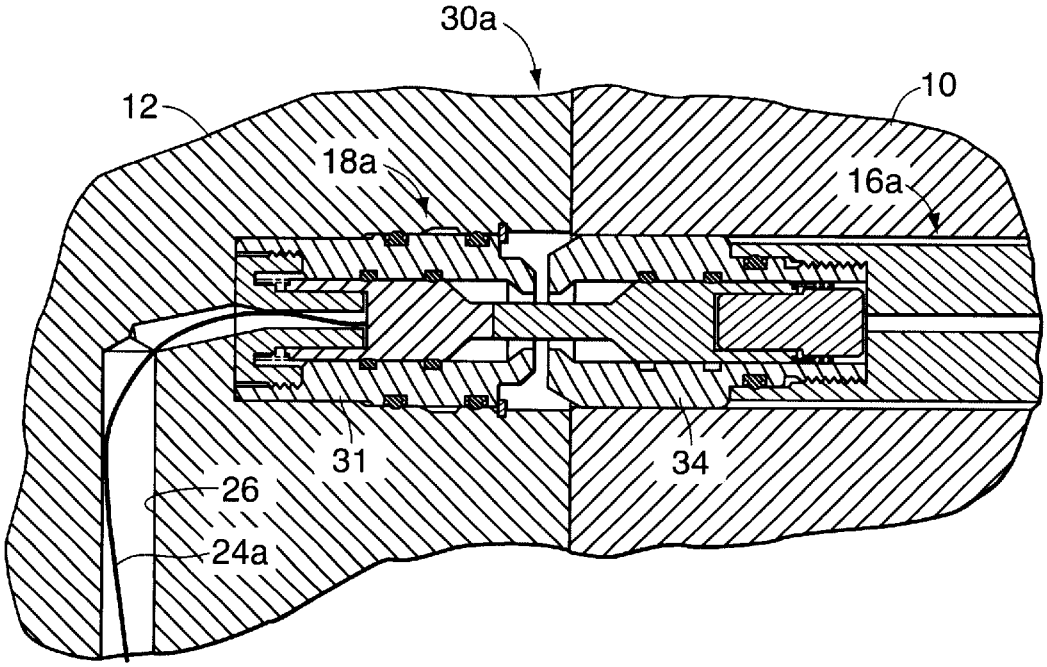
FIG. 2 is an enlarged sectional view on arrow A in FIG. 1 showing the penetrator assembly poppet valves in the open condition.
Figure 3:
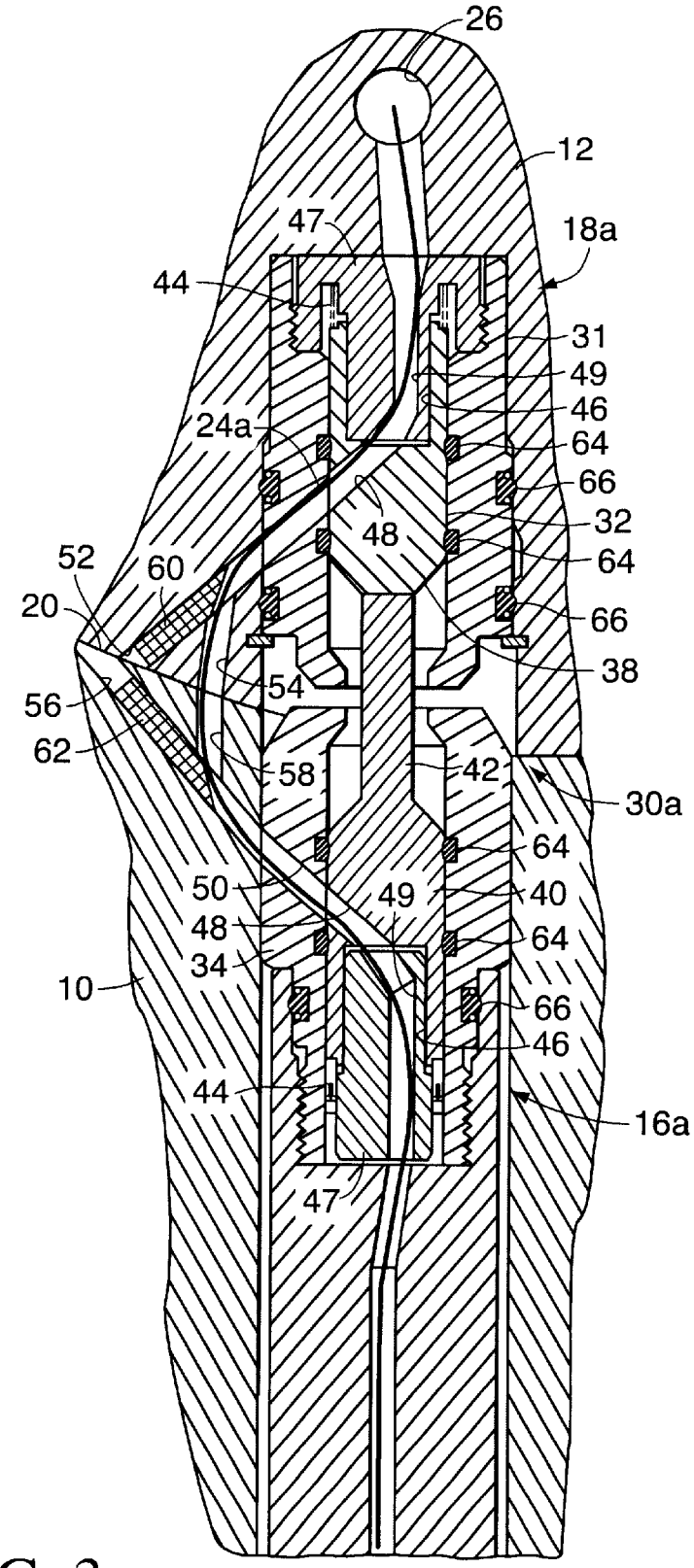
FIG. 3 is a further enlarged sectional view corresponding to FIG. 1, showing the left hand (open) poppet valves in more detail.
Figure 4:
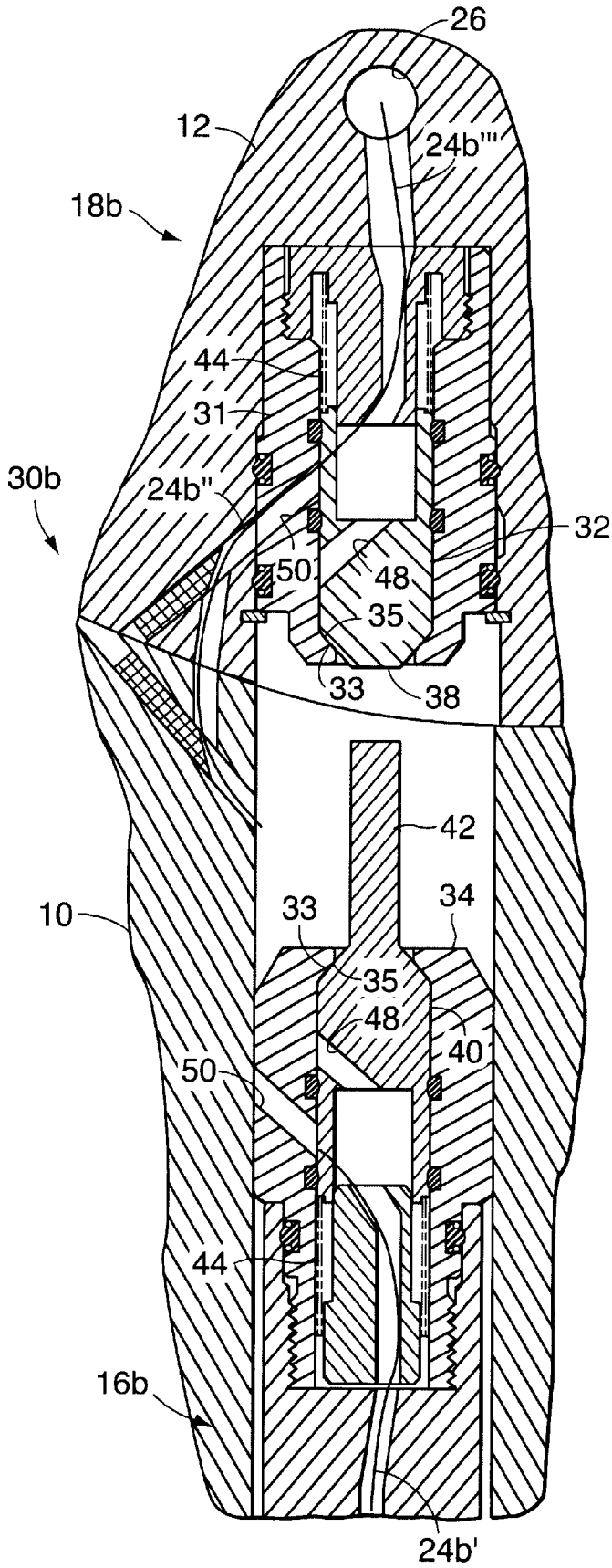
FIG. 4 is a view corresponding to FIG. 3 but showing the poppet valves in the closed condition.

As shown in mare detail in FIGS. 2–4, the female parts 18*a*, 18*b* and the inner ends of the male parts 16*a*, 16*b* are adapted to form double poppet valve assemblies 30*a*, 30*b* respectively. The female parts each comprise a valve housing 31, and the male parts a corresponding housing 34. Poppets 32 having short noses 38 are slidable in the housings 31 and poppets 40 having longer noses 42 are slidable in the housings 34, against the action of respective bias springs 44. The poppets 32, 40 each have an axial bore 46 with a plug 47 containing a smoothly joined series of drillings 49 juxtaposed to an oblique radial bore 48 in the poppets 32, 40. The housings 31, 34 each have an oblique radial born 50. A series of intercommunicating drillings 52, 54, 56, 58 are provided in the tubing hanger and tree. The drillings 52, 56 have suitably shaped plugs 60, 62 so that together with the drillings 54, 58 they form a single smoothly radiused passageway having an inner end in alignment with the bore 50 in the valve housing 31.

When the male parts 16*a*, 16*b* are extended towards the female parts 18*a*, 18*b*, the noses 38, 42 engage each other and the poppets are pushed back against their respective bias springs 44. In this position (FIG. 3) the respective poppet and valve housing bores 48 and 50 are brought into alignment, and the outer end of drilling 56 is aligned with the bore 50 in valve housing 34. The drillings in the plugs 47 are likewise moved adjacent to the inner ends of the bores 48. The line 24*a* can now be pumped through the plug 47 and bore 48 in poppet 40, bore 50 in valve housing 34, drillings 56, 58, 54, 52, bore 50 in valve housing 31, bore 48 and plug 47 in poppet 32, and downhole through bore 26. A proportion of the fluid used to pump the line downhole and back up again may flow into the cavity defined at the tubing hanger/tree interface 20, but sufficient flow will be established along the desired pathway for installation of the line.

When the penetrator male part is retracted (FIG. 4; 16*b* FIG. 1), the bias springs 44 extend the poppets 32, 40 in their respective housings 31, 34. The bores 48 in each of the poppets 32, 40 are thereby moved out of alignment with the bores 50 in each valve housing 31, 34, shearing the line 24*b* into three parts 24*b*', 24*b*", 24*b*"'. The bores 48 also move away from the plugs 47.

Furthermore, with the penetrators retracted, shoulders 33 on the poppets 32, 40 seal against corresponding shoulders 35 on the valve housings 31, 34. Annular seal elements 64 in the valve housings 31, 34 on either side of the bores 50 seal against the respective poppets 32, 40 to close off the bores 50. The double poppet valve arrangements 30*a*, 30*b* thus provide a double pressure barrier between the external environment and the tubing annulus connected to the bores 26. Valve housing 31 is sealed within the tubing hanger body 12 and valve housing 34 is sealed to the male penetrator parts 16*a*, 16*b* by annular seal elements 66. The penetrator male parts 16*a*, 16*b* are slidable in the packings 22 to maintain the tree pressure integrity as previously discussed.

With all the penetrator male parts retracted in the manner of part 16*b*, FIGS. 1 and 4, the tubing hanger 12 and the attached line parts 24*b*"' can be pulled from the tree 10. Poppet 40 and valve housing 34 provide a pressure barrier in the tree 10, allowing the line parts 24*b*' to be stripped from the penetrator male parts 16*b* and conduits 28*b* in safety. The short intermediate parts 24*b*" of the lines 24*b* are allowed to fall into the production casing, to be flushed out later. A replacement line is readily installed with the penetrator male parts returned to the extended position (16*a*, FIG. 1; FIG. 3) for example using a line feeding reel in a pressure tight housing sealingly connected to the conduits 28*a*, 28*b*.

It should be recognized that, while the present invention has been described in relation to the preferred embodiments thereof, those skilled in the art may develop a wide variation of structural and operational details without departing from the principles of the invention. Therefore, the appended claims are to be construed to cover all equivalents falling within the true scope and spirit of the invention.

What is claimed is:

1. In combination with a well assembly which comprises a first well component and a second well component that is positioned at least partially within the first well component, the improvement comprising a pressure barrier for retaining well fluid within the first well component, the pressure barrier comprising:

a penetrator assembly which comprises a first portion that is mounted on the first well component and a second portion that is mounted on the second well component;

the first portion being movable between a first position in which the first portion engages the second portion and a second position in which the first portion is disengaged from the second portion;

the first portion comprising a valve through which a data line extends between the first and second well components;

wherein the valve is sealably closable to sever the line.

2. A pressure barrier as defined in claim 1, characterized in that the second portion includes a further valve through which the line passes.

3. A pressure barrier as defined in claim 1, characterized in that the valve is closeable upon disengagement of the first and second portions.

4. A pressure barrier as defined in claim 1, characterized in that the valve is opened by engagement of the first and second portions.

5. A pressure barrier as defined in claim 1, characterized in that the valve comprises a poppet valve having sufficient closure bias to sever the line.

6. A pressure barrier as defined in claim 1, characterized in that the valve comprises a valve housing having a valve closure member movably received therein, the line passing through aligned apertures in the housing and closure member, movement of the closure member to close the valve causing the apertures to move out of alignment and sever the line.

7. A penetrator assembly for establishing communication between a first well component and a second well component which is supported in the first well component, the penetrator assembly comprising:

at least one retractable member which is mounted on the first well component;

a fixed member which is mounted on the second well component and is adapted to engage the retractable component;

a first conduit which, when the retractable member is in engagement with the fixed member, extends at least partially through the penetrator assembly from a second conduit in the first well component to a third conduit in the second weir component;

a data line which extends through the first, second and third conduits to establish communication between the first well component and the second well component; and first means positioned in the fixed member for severing the data line and sealing the third conduit when the retractable member is disengaged from the fixed member.

8. The penetrator assembly of claim 7, further comprising:

second means positioned in the retractable member for severing the data line and sealing the second conduit when the retractable member is disengaged from the fixed member.

9. The penetrator assembly of claim 8, wherein the second means comprises a second closure member having a second bore extending therethrough, the second closure member being movable in the retractable member such that, when the retractable member is engaged with the fixed member the second bore aligns with the first conduit, but when the retractable member is disengaged from the fixed member the second closure member severs the data line and seals the first conduit from the second conduit.

10. The penetrator assembly of claim 7, wherein the first means comprises a first closure member having a first bore extending therethrough, the first closure member being movable in the fixed member such that, when the retractable member is engaged with the fixed member the first bore aligns with the first conduit, but when the retractable member is disengaged from the fixed member the first closure member severs the data line and seals the first conduit from the third conduit.

* * * * *